US006293059B1

(12) United States Patent
Goodwin

(10) Patent No.: US 6,293,059 B1
(45) Date of Patent: Sep. 25, 2001

(54) HURRICANE PROTECTIVE SYSTEM FOR WINDOWS AND DOORS

(76) Inventor: Robert F. Goodwin, 1951 Teakwood Rd., Charleston, SC (US) 29414

( * ) Notice: Subject to any disclaimer, the term of this patent is extended or adjusted under 35 U.S.C. 154(b) by 0 days.

(21) Appl. No.: 09/490,850

(22) Filed: Jan. 24, 2000

(51) Int. Cl.[7] ..... E06B 3/26

(52) U.S. Cl. ..... 52/202; 52/426; 52/712; 52/713

(58) Field of Search ..... 52/202–203, 204.62, 52/656.6, 204.597, 204.67, 656.7, 656.5, 717.01, 426, 712, 713

(56) References Cited

U.S. PATENT DOCUMENTS

| | | | | |
|---|---|---|---|---|
| 3,926,400 | | 12/1975 | Franc . | |
| 4,248,022 | | 2/1981 | Walker . | |
| 4,450,884 | | 5/1984 | Hemmerle et al. . | |
| 4,708,554 | | 11/1987 | Howard . | |
| 4,726,560 | | 2/1988 | Dotson . | |
| 4,783,040 | | 11/1988 | Lindberg et al. . | |
| 5,050,365 | | 9/1991 | Edgar et al. . | |
| 5,351,456 | | 10/1994 | Paine, Jr. . | |
| 5,430,982 | * | 7/1995 | Bane | 52/202 |
| 5,487,244 | * | 1/1996 | Hill | 52/202 |
| 5,595,233 | | 1/1997 | Gower . | |
| 5,941,031 | * | 8/1999 | Fullwood | 52/202 |

* cited by examiner

*Primary Examiner*—Beth A. Stephan
(74) *Attorney, Agent, or Firm*—Harleston Law Firm; Kathleen M. Harleston

(57) ABSTRACT

A system for protecting a window or other opening to a building against hurricane-force winds, including: (a) four or more bolts, screws or rods; (b) four or more wedge brackets, each wedge bracket having a longitudinal slot along its centerline, and an aperture at the base of and continuous with the slot, the aperture having a diameter larger than the diameter of the bolt head, sloped sides along the slot, the slope along the sides decreasing from the top of the slot to the aperture at the bottom of the slot; and (c) one or two rectangular-shaped protective panels, each panel being of slightly larger length and width than the opening to be covered, each panel having an aperture in each corner area. The head of each bolt projects from each corner area of a molding or border along each opening to be covered; each bolt head projects through an aperture of the panel; and each bolt head projects through the longitudinal slot of each bracket, so that the bracket is fastened between the bolt head and an upper surface of the panel, and the panel covers the opening to be protected.

14 Claims, 4 Drawing Sheets

HURRICANE PROTECTIVE SYSTEM FOR WINDOWS AND DOORS

BACKGROUND OF THE INVENTION

1. Technical Field

The present device is a system for protecting windows, doors, and similar openings to a building against hurricane-force winds, more particularly a system comprising specially designed wedge brackets, bolts or screws that project year-round from the corners the openings, and a protective panel of sufficient size to cover the opening.

2. Background Information

An estimated six million single and double family dwellings, and many more commercial buildings, along United States coastlines are potentially affected by hurricanes as they spin their way up across the Atlantic Ocean or up through the Gulf of Mexico. As a hurricane bears down, homeowners and business people frequently prepare by nailing or screwing wooden boards up over windows and doors. Preparations are particularly feverish when a Category 4 or 5 hurricane is expected to make landfall. When a hurricane is expected to make landfall in the vicinity, the lines at lumber stores often stretch out into the parking lot and supplies of wooden boards, screws, and the like often run out. At the same time they are trying to protect their homes and valuables from the approaching hurricane, many people are simultaneously trying to pack up their children, elderly relatives, pets, clothing, photos, and other items to travel out of the path of the storm. They are concerned about getting out of the area before traffic jams occur. An easier, quicker system for protecting their homes and businesses is therefore much needed.

The present invention is a system for the homeowner or business person to use to protect their residences and other buildings from wind and rain damage. Anyone who is capable of lifting a board can implement this system over the windows and doors of a building.

BRIEF SUMMARY OF THE INVENTION

The present invention is a system for protecting a window or other opening to a building against an adverse weather event with high winds. The system comprises:

(a) four or more bolts, screws or rods, each between about two and ten inches in length;

(b) four or more wedge brackets, each wedge bracket having a longitudinal slot along a longitudinal centerline of the wedge bracket, and an aperture at the base of the slot and continuous with the slot, the slot having a width smaller than the diameter of the bolt head and greater than the diameter of the bolt stem, the aperture having a diameter larger than the diameter of the bolt head, sloped sides along the slot, the slope along the sides decreasing from a top end of the slot to the aperture at a bottom end of the slot; and (c) at least one rectangular-shaped protective panel, each panel being of slightly larger length and width than the opening to be covered, each panel having an aperture in each corner area. At least one of the bolts, screws, or rods engages the panel by extending through at least one of the apertures in the panel, and engages at least one of the brackets by extending through the longitudinal slot in the bracket, whereby the bracket is braced against the panel, and the panel is braced against the window or other opening.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
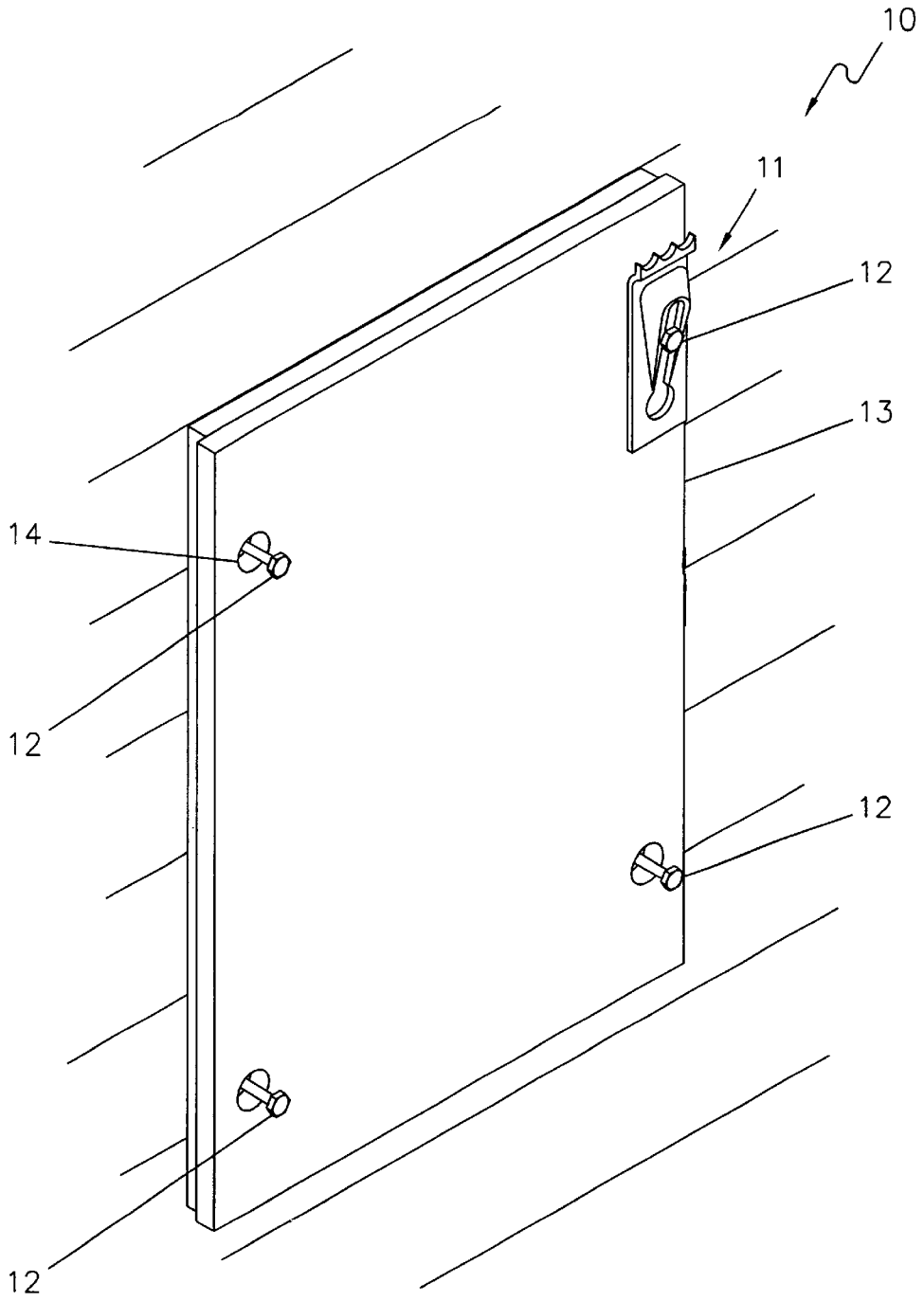
FIG. 1 shows a perspective view of a hurricane protective system according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIG. 1, a hurricane protective system 10 is shown in place over a window located on the outside of an exterior wall. It is comprised of three parts: unique wedge brackets 11, bolts 12, rods, or screws and one or more protective panels 13. Each panel 13, which is preferably a wooden or wood-containing board, comprises apertures 14 of sufficient diameter to accommodate the stem and head of a bolt. The apertures are generally located in the corner areas (approximately 12 inches from the corner) of each panel, and, for larger window or door sizes, at the middle of the panel along the sides. The apertures need not closely fit the bolt, as the bolt head must loosely pass through the aperture. The panels are preferably plywood with a thickness of between about ¼ and 1½ inches, most preferably between ½ and ¾ inch thick. Panels which have not been split or broken or spliced together are preferred for use herein. For single size windows, each panel should be slightly longer and wider (a few inches) than the window or other opening to be accommodated. For larger windows or double doors, it may be necessary to use two panels.

This hurricane protective system is especially designed for windows or doors with glass in them. The system may be used over single or double (large) size windows, bay windows, picture windows, sliding glass doors, French doors, double doors, single doors, front doors, or any type of exterior door or window or other opening for which protection is desired. It can be adapted for use on various types of window moldings, or even for windows or doors without wooden trim (moldings). This system can be applied on the exterior windows or doors of houses made of wood, stucco, brick veneer, or vinyl siding, for example. The primary purpose of this hurricane protective system is to provide a quick, easy system for home or business owners (or renters) to protect their windows or doors against glass breakage from hurricanes or other adverse weather events, like tropical storms, windstorms, nor'easters, etc. The invention can also be used over windows with jalousies, slats, protective bars, or roll-down or other types of shutters, or over screen doors, storm doors, or doors with jalousies. In addition to windows and doors, this invention can be used to cover similar types of openings to houses or other buildings. The invention could be adapted for use over the sides of screened-in porches to protect screens from high winds, or over an open side of a patio or foyer or covered walkway between buildings, or the like.

Figure 2:
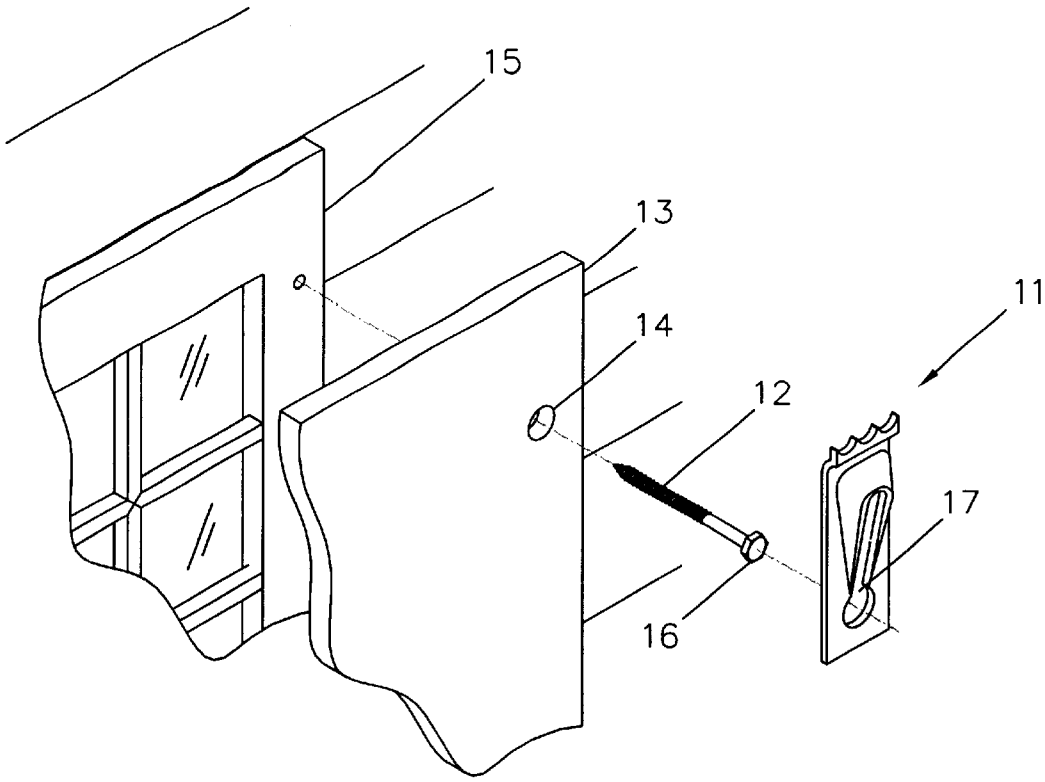
FIG. 2 is a perspective view of a hurricane protective system according to the present invention.

As shown in FIG. 2, the bolts 12, which are sometimes called lags, are long enough and sturdy enough to extend through the apertures and securely into window molding, or the exterior material of the house. The bolts are preferably made of stainless steel and between about two and eight inches in length, most preferably 3½ inch bolts and 5 inch bolts. Screws, or rods with heads, may be used in place of bolts, but they are less preferred. The bolt should be nailed into the window or door molding, so that the upper part of the stem of the bolt (and the bolt head) projects out several inches from the surface of the molding.

USE

In use, as shown in FIG. 2, the first part of the present hurricane protective system, the bolts are nailed into the window moldings. The bolts remain in the window or door molding, or on the house around the window or door. A screw may be used instead of the preferred bolt. One bolt has been placed near each corner of the window molding, or, in the absence of a molding, just outside the four corners of the window or other opening. After this initial placement of the bolts, hand tools are not needed to implement this system. When a hurricane is expected, preferably within about 24 hours of the hurricane's expected landfall, the user, normally the homeowner, puts up the second and third parts of the protective system, the panels and brackets. The four, sometimes six, apertures in each panel are placed over the four, or six, bolts at the outside corners of the window. To save time, the apertures have been pre-cut, and the panels have been labeled according to which window or door they fit over on the building. For example, the panels for a small house with eight single windows and a front picture window might be labeled F1, F2, F3TOP, F3BOT, RS 1, B1, B2, B3, L1, and L2, where F is front, R is right side, L is left side, and B is back. F3TOP is front, third opening and top location of a large window with two boards. F3BOT is a lower board on the same window.

As shown in FIGS. 1 and 2, the wedge bracket slips under the head of the bolt. One bracket is used on each bolt. The wedge brackets serve to secure the panel against the window or door frame. FIG. 1 shows the hurricane protective system in use, and FIG. 2 shows an exploded view of the system. There would ordinarily be four wedge brackets in place over a window, one in each corner. Since the bolts remain in the molding year-round, there is no ripping or shredding of the window moldings from repeatedly nailing panels up over the windows and then pulling them down each hurricane season. Also, the brackets are easy to slide over the bolt heads. No skill or extra labor is needed to nail nails into boards each hurricane season. Injuries from hammering nails and/or holding boards over windows while nails are hammered in are prevented. As shown in FIG. 2, the bolt is inserted in the window molding 15. Once the apertures 14 in the panel have been placed over the bolts, one bracket 11 is placed over each bolt head 16.

This system can be used by people of all ages. Anyone who can pick up a board can implement this system on ground floor windows and doors.

Figure 3:
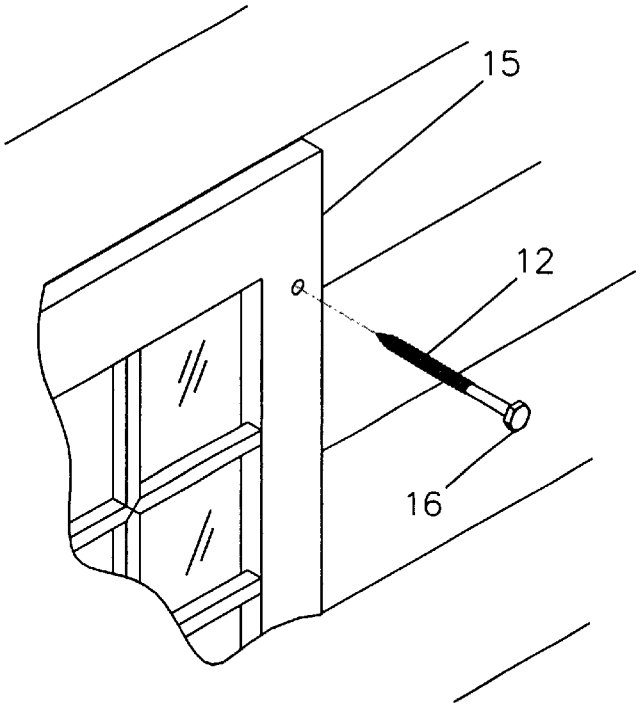
FIG. 3 is a perspective view of a bolt according to the present invention.

FIG. 3 shows the bolt in each corner of the window molding, but not the remainder of the hurricane protective system. In the seasons of the year when there are no hurricanes, these bolts remain in place on the house. During those seasons, the rest of the hurricane protective system (brackets and panels) are in storage. Decorative moldings, and designs can be placed over these bolts on the house, purely for aesthetic reasons. The homeowner can select these designs, which may be made of ceramic or plastic, for example. The designs may include Pennsylvania Dutch-type colorful designs, detailed, circular mandalas, pineapples, crowns, dental molding, roosters, frogs, gargoyles, personifications of the seasons of the year, etc. The designs may be placed one over each bolt and remain year-round, except when the hurricane protective system is in use. When the hurricane protective systems are in use, the decorative designs can be removed and stored until the systems are removed from each window. Then the decorative designs can be replaced once the hurricane has passed and the panels have been removed. Instead of the decorative designs, the bolts can be painted the same color as the trim, e.g., white lag, white trim, so that they blend in with the molding.

Figure 4:
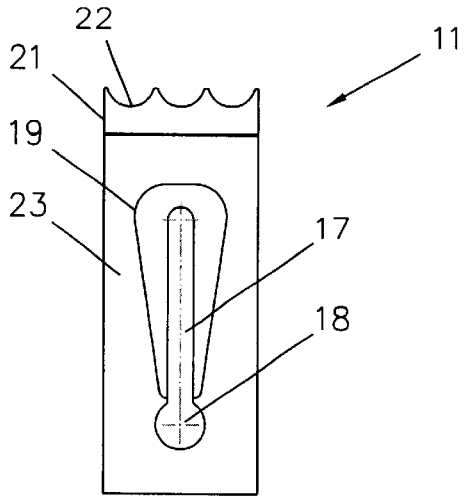
FIG. 4 is an elevational view of the front of a wedge bracket according to the present invention.
Figure 5:
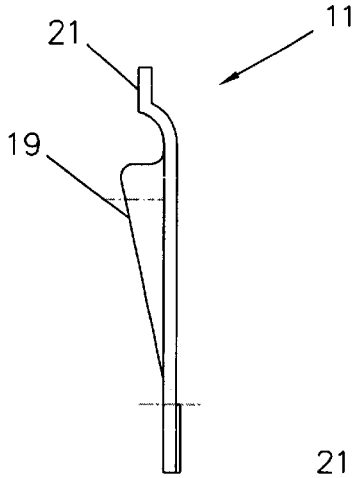
FIG. 5 is an elevational view of a side of a bracket according to FIG. 4.
Figure 6:
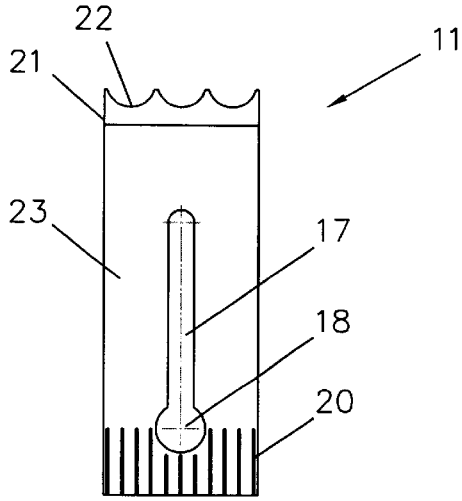
FIG. 6 is a elevational view of the back of a bracket according to FIG. 4.

If there is concern about snagging clothing or appendages on a bolt in high traffic areas, such as along a door molding, the bolts can be pounded or screwed all the way into FIG. 4 shows the front of a wedge bracket according to the present invention, FIG. 5 shows one side of the bracket, and FIG. 6 shows the back of the bracket. The left and right sides of the preferred bracket are mirror images. Referring to FIG. 4, a bracket 11 comprises a keyhole-shaped, longitudinal slot 17 along its centerline. The slot comprises a circular aperture 18 at its bottom. The circular bracket aperture 18 has a diameter slightly larger than the diameter of the bolt head 16.

As shown in FIGS. 4 and 5, the bracket 11 also comprises wedge sides 19 along the bracket slot 17. The effect of the wedge is that the sides of the top of the bracket increase in height, with the maximum height being at the top of the bracket. The wedge, then, slopes from the top down toward the aperture 18 at the bottom.

The wedge bracket 11 is shaped so that it can be easily held in the user's hand. After the panel has been placed over the opening, the user lines up the circular bracket aperture over the stationary bolt head. He or she maneuvers the bracket so that the bolt head passes through the circular bracket aperture 18. The bottom of the bracket is placed against the surface of the panel. In a quick motion, he then slides the bracket slot 17 down along the stem of the bolt. The bolts 12 must have a head of sufficient size to catch on the shoulder of the slot of the bracket. If the bolt head was too small, it would pass through the slot. As the bracket slides down along the bolt, the wedge takes up any remaining space between the bolt head and the surface of the panel.

This configuration facilitates assembly of the system without need for a hand tool of any sort. When a hurricane threatens, this time savings is important. It also means that even people with little mechanical dexterity can employ this system.

Without meaning to be bound by theory, it is believed that it is not the strength of the bracket that is important for optimal protection during a strong wind event. It is believed that the four brackets simply fasten down the panel. The brackets work to hold the panel over the window or door, even though the only connector between the bracket and the panel is the bolt. It is believed that the panel would give way in powerful hurricane force winds, such as those which are present in a Category 4 or 5 hurricane, rather than the brackets. The force of the winds on the exterior of the house are different than those which are exerted inside a house. On the outside, the winds are pushing powerfully against the panels. The brackets herein are used to hold the panels down. These brackets are not employed to prevent opposed forms from bowing out, as where snap ties are used to maintain a pre-determined spaced relation between opposed forms during pouring of concrete. Referring to FIG. 6, the bracket preferably has an abraded portion 20 on a bottom portion of the bracket. This can extend along the entire bottom, but is most important along the bottom quarter of the bracket. This abrasion helps to hold the bracket down along the panel underneath. It is believed that it is more difficult for winds to shear a bracket to the left or right (i.e. twist the bracket) if the bottom of the bracket is distressed rather than being smooth. The bottom of the bracket is otherwise relatively flat, except for the preferred slight lift at the top. A slight lift at the bottom of the bracket is less preferred.

Continuing to refer to FIGS. 4–6, there is preferably a slight lift 21 at the top of the bracket 11. This lift enables the user to grasp the top of the bracket and push down with his or her fingertips as a last step in fastening the bracket over the bolt head. The bracket most preferably has two or three curves 22 formed at the top of the lift 21/bracket 11. These (two or) three curves accommodate the first (two or) three fingers of the hand (forefinger, middle finger, and ring finger), so that the user can more easily pull down on the bracket when putting the system in place. The bracket also less preferably has two (or more) apertures: one in the upper right corner, and one in the lower left corner. A tack may be placed through each of these apertures into the panel below for extra fastening effect.

The shoulders 23 of the bracket alongside the slot preferably flatten and flare out for an inch or two on each side. This is for balance and it increases the amount of surface area of the bracket in contact with the plywood board. The flattened shoulders also make it more difficult for winds of high shear to lift the bracket at the edge and twist it. The flattened bracket shoulders also act like a washer to help to prevent the bolt heads from ripping through the board, hence pulling the board off the house. The bracket shoulders increase the surface area of the "washer" (the bracket) to prevent this rip-through from occurring.

Figure 7:
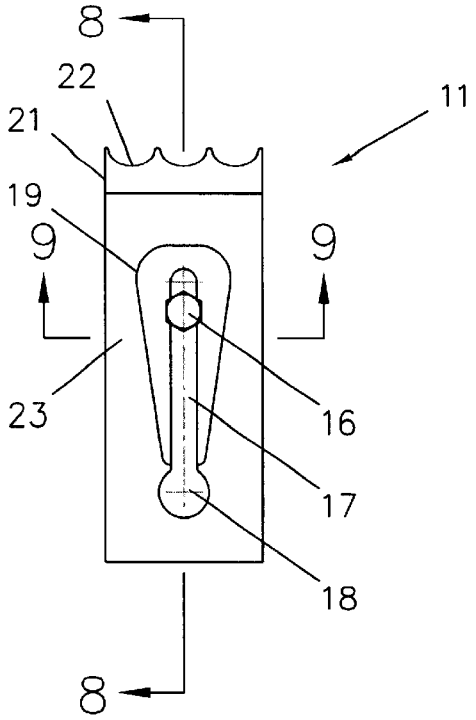
FIG. 7 is an elevational view of the front of a wedge bracket according to the present invention.
Figure 8:
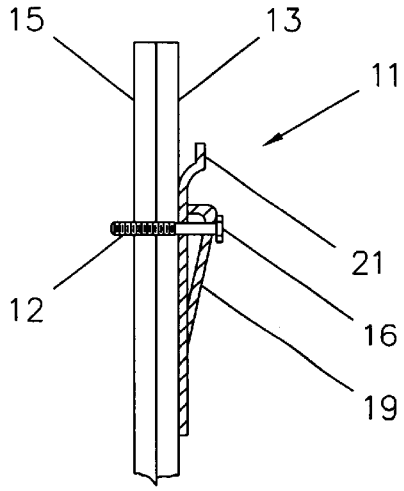
FIG. 8 is a cross-sectional view of a side of a bracket taken along line 8—8 of FIG. 7.
Figure 9:
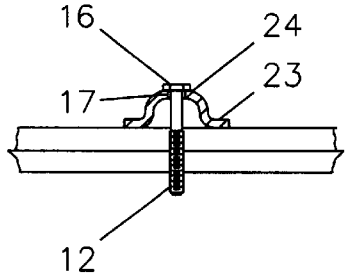
FIG. 9 is a cross-sectional view of the wedge bracket taken along line 9—9 of FIG. 7.

Referring to FIGS. 7–9, FIG. 7 shows the front of a wedge bracket 11 with a bolt head 16 in the bracket slot 17, FIG. 8 shows a longitudinal cross-section of the bracket across the bolt 12, and FIG. 9 shows a sagittal cross-section of the wedge bracket across the bolt 12.

In FIG. 8, a hurricane protective system is shown in place over a window. This cross-section is taken where the bolt 12 is inserted through the panel 13 and into the window molding 15. On a single window, there would be four brackets placed over four bolt heads.

As shown in FIG. 9, the shoulders 24 of the wedge bracket slot 17 are preferably flat to increase the amount of surface area of the bracket which contacts the underside of the bolt head 16. The fit between the wedge bracket and the bolt is therefore more secure.

The wedge brackets of the present invention are preferably made of a rust-proofed, sturdy, heavy material. They are preferably made of steel (most preferred), structural or hard plastic, vinyl, Fiberglas, and/or aluminum. The brackets are preferably painted with an electrostatically sprayed-on powder coating. Each bracket is preferably between about two and ten, most preferably about six, inches in length, and between about one and four, most preferably about two, inches in width. Each bracket is preferably between about ¼ and 1, most preferably about ¾, inch in height, or thickness. The majority of the (flattened portion of the) bracket is about ⅛ inch thick. Each bracket preferably weighs between about four and 12, most preferably about seven, ounces.

The invention includes a kit for protecting a window or other opening to a house from hurricane-force winds, the kit comprising:

(a) four or more bolts or screws between about two and ten inches in length; and (b) four or more wedge brackets, each bracket having a longitudinal slot along its centerline, and an aperture at the base of and continuous with the slot, the aperture having a diameter larger than the diameter of the bolt head, sloped sides along the slot, the slope along the sides decreasing from the top of the slot to the aperture at the bottom of the slot. The kit preferably further comprises: (c) one or two rectangular-shaped wooden or wood-containing panels, the panel being of slightly larger length and width than the window or other opening to be covered, each panel having an aperture in each corner. Preferably, each bracket further comprises a lift at the top of the bracket, the lift having a curved upper edge for accommodating fingertips of a user. The bracket preferably further comprises flattened shoulders alongside the slot, and an abraded portion on the bottom of the bracket.

The kit most preferably comprises: four to eight of the bolts, and four to six wedge brackets. Such a kit is for use on one window or door. The kit most preferably further includes adhesive labels or a marker for the panels, instructions for use, and sealer for preserving wooden panels (boards). The wedge brackets in a kit are preferably uniform in size, weight, and appearance, as are the bolts. A kit most preferably comprises bolts of two different lengths: four 3½ inch bolts and four 5 inch bolts. The former are for standard wooden window moldings, and the latter are in case the house has vinyl siding, which necessitates a longer bolt. The kit may also include a protective panel pre-sized to fit over the window or other opening to be covered. Several protective panels can be overlapped to cover a larger opening.

For maximum advantage, this hurricane protective system should be employed over each window and door on the home. It is not necessary for all windows or doors to be covered, however, for advantages to be seen. Even if there is only time to cover one window, that window is protected. It has been shown that most damage to homes in hurricanes comes from a loose item outside, such as an outdoor grill, toy, implement, or lawn chair, being picked up by the wind and thrown through a window. Once a window is breached, wind and rain from the hurricane will do additional damage inside the house or business. The present system is an easy, quick way to protect the home or office when time is of the essence, as it is when a hurricane is approaching. It may also be used for windows and doors on residential or commercial buildings in geographic areas where tropical storm or hurricane-force winds may occur, such as the Northeast (where nor'easters are common), or some areas of the Southwest, where sandstorms may occur.

This invention further comprises a method of use for protecting a window or an opening to a building against adverse effects from tropical storm or hurricane force winds, comprising the steps of:

(a) cutting apertures in a protective panel, one aperture in each corner, the apertures being of sufficient size to accommodate the head of a bolt;

(b) nailing bolts, each having a bolt head and a bolt stem projecting from the bolt; head, in each corner of a molding or border along the window or other opening to be protected, so that the bolt heads and an upper portion of each bolt stem project outwardly from the molding or border;

(c) placing the apertures of the protective panel over the corresponding bolt heads on the molding or border, so that the bolts loosely support the panel; and (d) sliding a wedge bracket over each bolt head, and pushing it in a downward direction, so that the bracket fits tightly between the bolt head and the upper surface of the panel; wherein the bracket comprises: 1) a longitudinal slot along the approximate centerline of the bracket; 2) an aperture larger than the diameter of the bolt head at the base of the slot; 3) sloped sides along the slot, the slope along the sides decreasing from the top of the slot to the aperture at the bottom of the slot; and 4) a lift at the top of the bracket. Further, the protective panels are removed after the tropical storm or hurricane has passed by: a) driving the wedge brackets in an opposite direction, b) removing the brackets from the bolt heads, and then c) lifting the panels off the bolts. Preferably, the panel is rectangular-shaped, wooden or wood-containing, and between about ¼ and 1½ inches thick; the lift on the wedge bracket comprises a curved upper edge for accommodating fingertips of a user; and the wedge bracket further comprises flattened shoulders alongside the slot.

From the foregoing it can be realized that the described device of the present invention may be easily and conveniently utilized to protect against damage from hurricanes. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS (For Information Only)

10 hurricane protective system
11 bracket
12 bolt
13 wooden panel
14 apertures in panel
15 window molding
16 bolt head
17 bracket slot
18 circular bracket aperture
19 wedge on bracket
20 abraded portion of bracket bottom
21 bracket lift
22 fingertip curves in lift
23 flattened shoulders of the bracket
24 flattened shoulders of the slot

What is claimed is:

1. A system for protecting a window or another opening on a building against an adverse weather event with high winds, the system comprising:

(a) four or more bolts, screws or rods, each between about two and ten inches in length;

(b) four or more wedge brackets, each wedge bracket having a longitudinal slot along a longitudinal centerline of the wedge bracket, and an aperture at the base of the slot and continuous with the slot, the slot having a width smaller than the diameter of the bolt head and greater than the diameter of the bolt stem, the aperture having a diameter larger than the diameter of the bolt head, sloped sides along the slot, the slope along the sides decreasing from a top end of the slot to the aperture at a bottom end of the slot; and (c) at least one rectangular-shaped protective panel, each panel being of slightly larger length and width than the opening to be covered, each panel having an aperture in each corner area; and wherein at least one of the bolts, screws, or rods engages the panel by extending through at least one of the apertures in the panel, and engages at least one of the brackets by extending through the longitudinal slot in the bracket, whereby the bracket is braced against the panel, and the panel is braced against the window or other opening.

2. A system according to claim 1, wherein the wedge bracket further comprises a lift at a top portion of the bracket.

3. A system according to claim 2, wherein the wedge bracket further comprises an abraded portion on a bottom portion of the bracket.

4. A system according to claim 3, wherein the bracket lift further comprises a curved upper edge adapted for accommodating at least two fingertips of a user.

5. A system according to claim 4, wherein the wedge bracket further comprises flattened shoulders alongside the slot.

6. A method of use for protecting a window or another opening on a building against adverse effects from tropical storm or hurricane force winds, comprising the steps of:

(a) cutting apertures in a protective panel, one aperture in each corner area, the apertures being of sufficient size to accommodate the head of a bolt;

(b) nailing bolts, each having a bolt head and a bolt stem projecting from the bolt head, in each corner area of a molding or border along the window or other opening to be protected, so that the bolt heads and an upper portion of each bolt stem project outwardly from the molding or border;

(c) placing the apertures of the protective panel over the corresponding bolt heads on the molding or border, so that the bolts loosely support the panel; and (d) sliding a wedge bracket over each bolt head, and pushing it in a downward direction, so that the bracket fits tightly between the bolt head and the upper surface of the panel; wherein the bracket comprises: 1) a longitudinal slot along the approximate centerline of the bracket; 2) an aperture larger than the diameter of the bolt head at the base of the slot; 3) sloped sides along the slot, the slope along the sides decreasing from the top of the slot to the aperture at the bottom of the slot; and 4) a lift at the top of the bracket.

7. A method of use according to claim 6, wherein the protective panels are removed after the tropical storm or hurricane has passed by: a) driving the wedge brackets in an opposite direction, b) removing the brackets from the bolt heads, and then c) lifting the panels off the bolts.

8. A method of use according to claim 7, wherein the panel is rectangular-shaped, wooden or wood-containing, and between about ¼ and 1½ inches thick.

9. A method of use according to claim 8, wherein the lift on the wedge bracket comprises a curved upper edge adapted for accommodating fingertips of a user.

10. A method of use according to claim 8, wherein the wedge bracket further comprises flattened shoulders alongside the slot.

11. A kit for protecting a window or other opening to a house from hurricane-force winds, the kit comprising:

(a) at least four bolts or screws between about two and ten inches in length;

(b) at least four wedge brackets, each bracket comprising a longitudinal slot along its centerline, and an aperture at a bottom end of the slot and continuous with the slot, the aperture having a diameter larger than the diameter of the bolt head, sloped sides along the slot, the slope along the sides decreasing from a top end of the slot to the aperture at the bottom end of the slot; and (c) at least one rectangular-shaped wooden or wood-containing panel, each panel being of slightly larger length and width than the opening to be covered, and each panel comprising an aperture in a corner area.

12. A kit according to claim 11, wherein each wedge bracket further comprises a lift at the top of the bracket, the lift having a curved upper edge for accommodating fingertips of a user.

13. A kit according to claim 11, wherein the wedge bracket further comprises flattened shoulders alongside the slot.

14. A kit according to claim 11, wherein the wedge bracket further comprises an abraded portion on the bottom of the bracket.

* * * * *